United States Patent [19]

Musgrave

[11] 4,043,065

[45] Aug. 23, 1977

[54] PISTOL CHARGING SOCKET

[76] Inventor: Daniel Dennis Musgrave, 8201 Caraway St., Cabin John, Md. 20731

[21] Appl. No.: 732,070

[22] Filed: Oct. 13, 1976

[51] Int. Cl.[2] ..... F41C 27/00; F41C 33/02

[52] U.S. Cl. ..... 42/1 R; 224/2 B

[58] Field of Search ..... 42/90, 1 R; 89/1 K; 224/2 B, 2 C

[56] References Cited

U.S. PATENT DOCUMENTS

| | | | |
|---|---|---|---|
| 3,763,587 | 10/1973 | Firmalino | 42/1 R |
| 3,804,306 | 4/1974 | Azurin | 224/2 B |
| 3,999,321 | 12/1976 | Musgrave | 42/1 A |

*Primary Examiner*—Charles T. Jordan

[57] ABSTRACT

A socket for charging a pistol of the type charged by relative motion between a slide and a frame. The socket can be mounted on a holster, on an ammunition pouch on the person of the user, or on a vehicle. The socket makes it possible to charge the pistol with only one hand, whereas two hands are normally required.

6 Claims, 6 Drawing Figures

PISTOL CHARGING SOCKET

In the preparation of automatic or semiautomatic weapons for firing, the first cartridge must be moved into position for firing by externally powered means. This process is commonly called charging. The charging process may be arranged so as to cause other preparatory steps to be accomplished simultaneously, such as the cocking of a firing hammer. But it is immaterial to the present invention if such additional steps result from charging.

This invention is concerned with a certain particular class of pistols, those having a recoiling slide, moving relative to a frame which is non-recoiling to the extent that it is held by the shooter. When the slide is in its forward position it surrounds the top and sides of the barrel except at the muzzle. When the slide recoils it exposes a considerable portion of the barrel which recoils only slightly, or in some designs, not at all relative to the frame. In effect, charging this type of pistol might be said to consist of recoiling the slide by hand, and then releasing it. As one hand must hold the frame, charging such a pistol will normally require two hands.

In addition to preparing to fire, charging is sometimes accomplished for other purposes, such as to eject a defective cartridge which fails to fire, and replace it with another. It may sometimes happen that charging must be done quickly while only one hand is free for this purpose.

In consideration of the foregoing, the principal object of this invention is to provide a charging socket, quickly useable with one hand.

This and other objects of the present invention will be apparent upon reference to the following specification, taken in connection with the accompanying drawings, wherein.

The various illustrations are for purpose of disclosure and should not be considered limiting. The invention is disclosed without reference to any particular model of pistol. In actual practice, it may be necessary to shape the socket to the configuration of the pistol used to assure the correct charging stroke.

Figure 1:
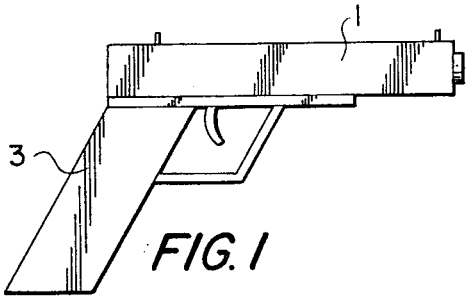
FIG. 1 is a schematic sketch of a pistol.

Referring now to the drawings in detail, FIG. 1 is a schematic sketch of a pistol having a slide 1 and a frame 3. In FIG. 1 the slide is in its forward position.

Figure 2:
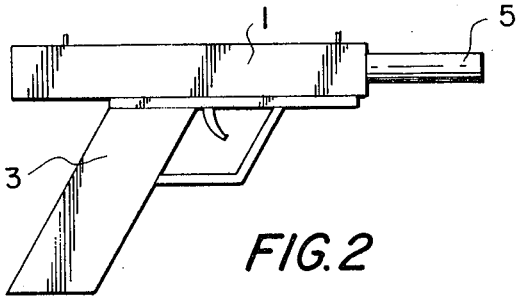
FIG. 2 is similar to FIG. 1 but the parts of the pistol are in a different relationship.

FIG. 2, also schematic, shows slide 1 drawn back to the rear, thus exposing a considerable portion of barrel 5.

Charging the pistol is accomplished by manually drawing slide 1 rearward from its position in FIG. 1 to its position in FIG. 2, and releasing it. The slide is then returned to its forward position by a spring in the pistol.

Figure 3:
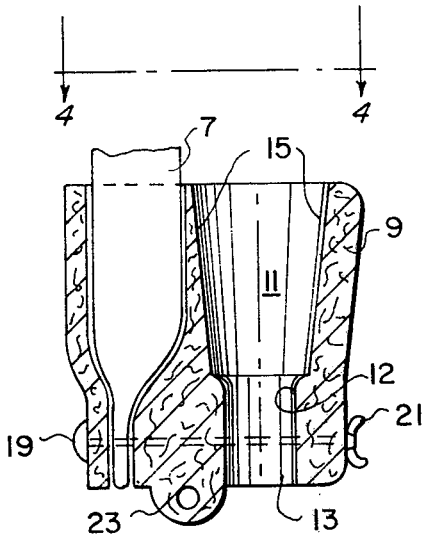
FIG. 3 is a sectional view of a charging socket for a pistol, installed on a holster.

FIG. 3 shows a charging socket mounted on the lower portion of a holster 7. It comprises generally a block 9 having formed therein a socket 11 adapted to enclose the front portion of a slide of a pistol. Formed in the base of the socket is a passage 13, having a chamfered edge 12, and adapted to accomodate a barrel protruding from a slide inserted in socket 11. As indicated at 15 the walls of the socket are flared to facilitate insertion of the slide into the socket.

Also formed in the block is a slot 17 which is adapted to receive the lower portion of holster 7. A bolt 19 or any other convenient type of fastener passes through suitable holes in the block and the holster, and is retained therein by nut 21. A loop 23 is formed on the block to permit engaging a thong (not shown) therewith. The thong can be used to tie the device to the leg of the user, to keep it always positioned for charging as described below.

Figure 4:
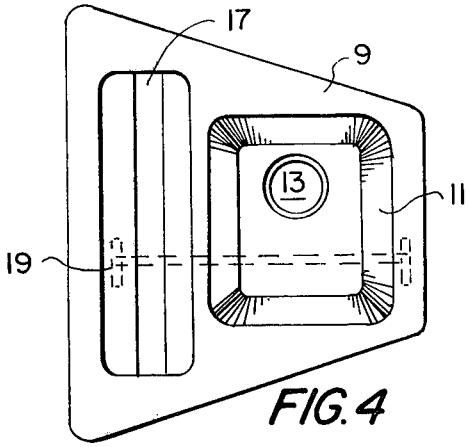
FIG. 4 is a top view of a socket, taken in the direction indicated by lines 4—4 on FIG. 3.
Figure 5:
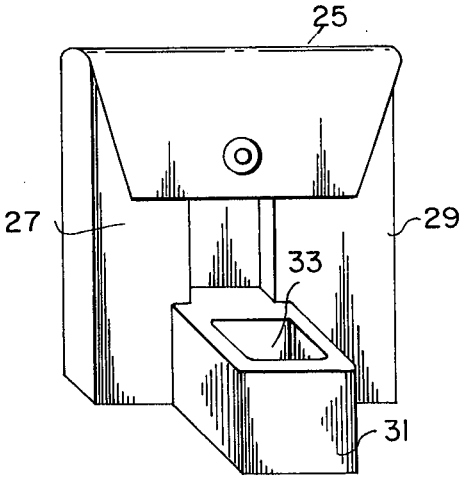
FIG. 5 is a view of a magazine pouch with a charging socket installed thereon.

FIG. 5 shows a magazine pouch 25 of the type frequently used with pistols. The pouch has compartments 27 and 29 for magazines and has means on the back (not visible in FIG. 5) for suspending the pouch from the person of a user. Mounted on the pouch by any convenient means is block 31 which has formed therein socket 33. Details of the socket, although not visible in FIG. 5 are similar to those of socket 11, in FIGS. 3 and 4.

Figure 6:
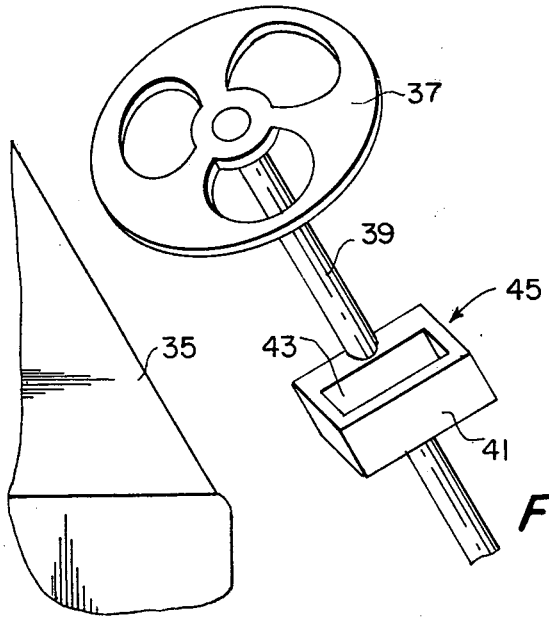
FIG. 6 is a partial view of the interior of a motor vehicle with a charging socket mounted thereon.

FIG. 6 shows a portion of a vehicle or other conveyance having a seat 35, steering wheel 37, and steering column 39. Fixed to the column by any convenient means is block 41 having formed therein socket 43. On the rim of the socket is a luminescent mark 45 which serves to indicate its location under conditions of darkness.

The method of using sockets 11, 33, or 43 is virtually identical. A pistol, presumably ready to be charged, is inserted in the socket, oriented so that the muzzle of its barrel is alined with passage 13. The frame of the pistol is then pushed toward the socket which is engaging the slide. As the frame moves it pushes the barrel into passage 13. When this downward movement is completed, the frame is lifted, and the usual spring means within the pistol drives the slide to its forward position, completing the charging process. As the sockets are either suspended or fixed, the charging process can be accomplished with one hand.

It is desired to emphasize that the socket is shown in a simplified form for purposes of disclosure. In actual practice the socket would be shaped and dimensioned to be compatible with the frame, slide and other details of the pistols used with it. Although the socket is shown in the drawings as a separate item, it could be made integral with the holster or the pouch. For convenience, the term charging socket has been used herein before, but it should be noted that the utility of the invention is not restricted to charging, as it can be employed for any purpose which requires moving the slide through its cycle of operation without firing.

The charging socket can be constructed of any suitable material, such as leather, wood, metal, plastic, or a combination of several materials. The statement that the socket can be mounted on a vehicle or other conveyance should be construed in a broad sense to include ground vehicles, aircraft and boats. The socket can be modified in certain details to be compatible with more than one pistol, or to suit the special characteristics of any pistol. This would be necessary for instance, if the front face of the slide must be drawn back past the front face of the frame to charge a particular model. In such an instance, a recess could be formed in the bottom of the socket to allow the frame to protrude somewhat beyond the front face of the slide.

What I claim is:

1. A charging device for a pistol charged by relative motion between a frame and a slide, comprising: a holster; external socket means on said holster positionally adapted for enclosing a portion of said slide and for blocking movement of said slide toward the lower extremity of said holster; and passage means in said socket means positionally adapted to accomodate a barrel protruding through the front of said slide during charging.

2. A device as set forth in claim 1 further characterized by said socket means having flaring walls.

3. A device as set forth in claim 1 further characterized by said socket means being adapted to enclose various slides having differing configurations.

4. A device as set forth in claim 1 further characterized by means for engaging a thong therewith.

5. A device as set forth in claim 1 further characterized by said socket means being fabricated separately for attachment to said holster.

6. A charging device for a pistol charged by relative motion between a frame and a slide comprising: a pouch adapted to be supported on a person; external socket means on said pouch positionally adapted for enclosing a portion of said slide and for blocking movement of said slide toward the lower extremity of said pouch; and passage means in said socket means positionally adapted to accomodate a barrel protruding through the front of said slide during charging.

* * * * *